US005653060A

United States Patent [19]

Kitada et al.

[11] Patent Number: 5,653,060

[45] Date of Patent: Aug. 5, 1997

[54] SLIDING WINDOW STRUCTURE

[75] Inventors: Ryuichi Kitada; Toshihiko Saito, both of Toyama-ken, Japan

[73] Assignee: YKK Architectural Products Inc., Tokyo, Japan

[21] Appl. No.: 518,817

[22] Filed: Aug. 24, 1995

[30] Foreign Application Priority Data

Aug. 31, 1994 [JP] Japan ..... 6-206902
Aug. 31, 1994 [JP] Japan ..... 6-206917

[51] Int. Cl.[6] ..... E05D 15/16

[52] U.S. Cl. ..... 49/404; 49/DIG. 1; 49/505

[58] Field of Search ..... 49/406, 408, 424, 49/458, 504, 505, DIG. 1, 404, 209, 207; 52/204.51, 209, 207

[56] References Cited

U.S. PATENT DOCUMENTS

| | | | |
|---|---|---|---|
| 4,202,137 | 5/1980 | Randall . | |
| 4,815,245 | 3/1989 | Gartner | 49/DIG. 1 |
| 4,815,246 | 3/1989 | Haas | 52/207 |
| 4,875,316 | 10/1989 | Johnston | 52/207 |
| 4,924,628 | 5/1990 | Ruby et al. | 49/404 |
| 4,944,118 | 7/1990 | Biro | 52/207 |
| 5,274,955 | 1/1994 | Dallaire et al. | 49/406 |
| 5,280,606 | 1/1994 | Davies | 49/406 |

FOREIGN PATENT DOCUMENTS 1-11911 4/1989 Japan .

3-68279 7/1991 Japan .

*Primary Examiner*—Brian K. Green
*Assistant Examiner*—Curtis A. Cohen
*Attorney, Agent, or Firm*—Finnegan, Henderson, Farabow, Garrett & Dunner, L.L.P.

[57] ABSTRACT

A sliding window comprises a window frame composed of upper, lower, and first and second vertical frame members, to which indoor side and outdoor side sashes are mounted. A space continuous around the periphery of the window frame is formed to the outdoor side of the window frame. The space is provided with a port communicating with the outdoor atmosphere, thereby having a pressure equal to an atmospheric pressure. The window frame, the indoor side sash and the outdoor side sash have respectively heat insulating lines continuous around their respective peripheries. The indoor side sash is mounted to the window frame at the indoor side relative to the heat insulating line of the window frame, and the outdoor side sash is mounted to the window frame in such manner that the outdoor side portion relative to the heat insulating line of the outdoor side sash are positioned at the outdoor side relative to the heat insulating line of the window frame and the indoor side portion relative to the heat insulating line of the outdoor side sash is positioned at the indoor side relative to the heat insulating line of the window frame. When the indoor side sash and the outdoor side sash are closed, an air layer is formed at a mating portion between the indoor side sash and the outdoor side sash.

6 Claims, 5 Drawing Sheets

SLIDING WINDOW STRUCTURE

BACKGROUND OF THE INVENTION

The present invention relates to a sliding window structure, and more particularly, a sliding window having an improved air-tight structure and/or an improved heat insulating structure.

The prior art documents of Japanese Utility Model Publication No. HEI 1-11911 and Japanese Utility Model Laid-open Publication No. HEI 3-68279 discloses a sliding window structure in which an indoor side sash or shoji (called hereinbelow sash) is mounted to an indoor side portion of a window frame so as to be slidable or movable in the width direction of the window frame and an outdoor side sash is mounted to an outdoor side portion of the window frame and fixed to the side of one of the vertical frame members of the window frame. In such sliding window structure, it is known that auxiliary upper and lower frame members are attached to outdoor side portions of upper and lower frame members of the window frame on the side of a vertical frame member opposite to the vertical frame member to which the outdoor side sash is fixed, and that an auxiliary vertical frame member is attached to an outdoor side portion of that vertical frame member, so as to improve an air-tight performance. When the indoor side sash is closed, these auxiliary upper, lower and vertical frame members are pressed against the indoor side sash through air-tight members, thereby forming an upper transverse space, a lower transverse space and a vertical space therebetween. The lower transverse space is opened to the outdoors so as to make a pressure in the lower transverse space equal to an atmospheric pressure, thereby improving an air-tight performance.

In such known air-tight structure, it is aimed to achieve an improved air-tightness between the window frame and the indoor side sash, but no attention is paid for improving the air-tightness between the window frame and the outdoor side sash.

In the slinding window structure of the described prior art publications, a window glass constituting the outdoor side sash is supported directly to the upper, lower and one vertical frame members through the air-tight members.

However, there is another type of sliding window structure in which the glass is fitted to an upper frame element, a lower frame element, a window end frame element and a mating frame element which constitute an outdoor side sash, and these frame elements are fixed to the window frame. In this type of sliding window structure, it remains to slove a problem on the air-tightness between the window frame and the outdoor side sash.

From another view point in respect of the sliding window structure, that is, the view point of improving a heat insulating performance, the prior art document of U.S. Pat. No. 4,202,137 discloses a sliding door or window in which a window frame is composed of an upper frame member, a lower frame member and bilateral vertical frame members assembled in a rectangular shape, each of which frame members is formed of a heat insulating frame unit which is formed by connecting an indoor side member and an outdoor side member through a heat insulating member, and an indoor side sash is fitted to the indoor side of the window frame and an outdoor side sash is fitted to the outdoor side of the window frame with the heat insulating members of the window frame being interposed therebetween.

The indoor side upper, lower, end and mating frame elements constituting the indoor side sash are each formed of a heat insulating frame Knit which is formed by connecting an indoor side member and an outdoor side member through a heat insulating member, and the outdoor side upper, lower, end and mating frame elements constituting the outdoor side sash are also each formed of a heat insulating frame unit which is formed by connecting an indoor side member and outdoor side member through a heat insulating member.

According to this heat insulating structure, the heat insulating members of the window frame have the same location in the depth direction of the window frame, thereby forming a continuous heat insulating line in the peripheral direction of the window frame. However, the heat insulating members of the indoor side sash do not have the same location in the depth direction of the indoor side sash, thus not forming a continuous heat insulating line in the peripheral direction of the indoor side sash. Similarly, the insulating members of the outdoor side sash do not have the same location in the depth direction of the outdoor side sash, thus not forming a continuous heat insulating line in the peripheral direction of the outdoor side sash. Furthermore, since the outdoor side sash is mounted to the outdoor side relative to the heat insulating line of the window frame, the mating portions of the indoor side and outdoor side mating frame elements are not sufficiently heat insulated, thus providing a problem.

SUMMARY OF THE INVENTION

The object of the present invention is to substantially eliminate defects or drawbacks encountered in the prior art described above.

More specifically, a first object of the present invention is to provide a sliding window having an improved air-tight structure.

A second object of the present invention is to provide a sliding window having an improved heat insulating structure.

A third object of the present invention is to provide a sliding window provided with an improved air-tight structure and an improved heat insulating structure.

The first object can be achieved by one aspect of the present invention, according to which, there is provided a sliding window comprising:

a window frame of a rectangular shape comprising, in an installed state, an upper frame member, a lower frame member, and first and second vertical frame members;

an indoor side sash comprising an indoor side upper frame element, an indoor side lower frame element, an indoor side end frame element and an indoor side mating frame element; and an outdoor side sash comprising an outdoor side upper frame element, an outdoor side lower frame element, an outdoor side end frame element and an outdoor side mating frame element, wherein the indoor side sash is mounted at an indoor side of the window frame so as to be slidable in the width direction of the window frame and to establish air-tightness between the window frame and the indoor side sash when the indoor side sash is closed, wherein the outdoor side sash is mounted at an outdoor side of the window frame and fixed to the first vertical frame member in such manner that a first upper transverse space is defined between the upper frame member and the outdoor side upper frame element, a first lower transverse space is defined between the lower frame member and the outdoor side lower frame element and a first vertical space is defined between the first vertical frame member and the outdoor side end frame element, the first vertical space communicating with the first upper transverse space and the first lower transverse space, wherein the upper frame member is provided at its outdoor side with an auxiliary upper frame member on the side of the second vertical frame member so as to define therebetween a second upper transverse space communicating with the first upper transverse space, the lower frame member is provided at its outdoor side with an auxiliary lower frame member on the side of the second vertical frame element so as to define therebetween a second lower transverse space communicating with the first lower transverse space, and the second vertical frame member is provided at its outdoor side with an auxiliary vertical frame member so as to define therebetween a second vertical space communicating with the second upper and second lower transverse spaces, and wherein at least one of the first upper transverse space, the first lower transverse space, the first vertical space, the second upper transeverse space, the second lower transverse space and the second vertical space is provided with a port communicating with an atmosphere outside the window, whereby the first upper transverse space, the first lower transverse space, the first vertical space, the second upper transverse space, the second lower transverse space and the second vertical space form at the outdoor side of the window frame a space continuous in the peripheral direction of the window frame and having a pressure equal to the atmospheric pressure outside the window.

The port may be a drain port formed to the first lower transverse space.

The respective frame members constituting the window frame, the respective frame elements constituting the indoor side sash and the respective frame elements constituting the outdoor side sash may be formed of heat insulating frame units.

According to this aspect of the present invention, the space having a pressure equal to the atmospheric pressure outside the window is formed at the outdoor side of the window frame continuously in the peripheral direction thereof, thereby providing an improved air-tightness between the window frame and the indoor side sash and between the window frame and the outdoor side sash.

According to another aspect of the present invention, there is provided a sliding window comprising:

a window frame of a rectangular shape comprising, in an installed state, an upper frame member, a lower frame member, and first and second vertical frame members;

an indoor side sash comprising an indoor side upper frame element, an indoor side lower frame element, an indoor side end frame element and an indoor side mating frame element; and an outdoor side sash comprising an outdoor side upper frame element, an outdoor side lower frame element, an outdoor side end frame element and an outdoor side mating frame element, wherein the upper, lower, and first and second vertical frame members of the window frame are respectively formed of heat insulating frame units and provide a heat insulating line continuous in the peripheral direction of the window frame, wherein the indoor side upper, lower and end frame elements of the indoor side sash are respectively formed of heat insulating frame units, the indoor side mating frame element thereof is composed of a heat insulating frame unit and an outside vertical member connected to the heat insulating frame unit, and the indoor side upper, lower, end and mating frame elements provide a heat insulating line continuous in the peripheral direction of the indoor side sash, wherein the outdoor side upper, lower and end frame elements of the outdoor side sash are respectively formed of heat insulating frame units, the outdoor side mating frame element thereof is composed of a heat insulating frame unit and an outside vertical member connected to the heat insulating frame unit, and the outdoor side upper, lower, end and mating frame elements provide a heat insulating line continuous in the peripheral direction of the outdoor side sash, wherein each of the heat insulating frame units comprises an indoor side member and an outdoor side member which are connected together through a heat insulating member, wherein the indoor side sash is mounted to the indoor side relative to the heat insulating line of the window frame, and the outdoor side sash is mounted to the window frame in such manner that the outdoor side members of the respective frame elements of the outdoor side sash are positioned at the outdoor side relative to the heat insulating line of the window frame and the indoor side members of the respective frame elements of the outdoor side sash are positioned at the indoor side relative to the heat insulating line of the window frame, and wherein when the indoor side and outdoor side sashes are closed, the outside vertical member of the indoor side mating frame element is opposed to the indoor side member of the outdoor side mating frame element and the outdoor side member of the indoor side mating frame element contacts the outside vertical member of the outdoor side mating frame element through an air-tight member, thereby forming an air layer at a mating portion formed by the indoor side and outdoor side mating frame elements.

In a preferred embodiment, the respective indoor side members of the upper, lower, left side vertical and right side vertical frame members have the same dimensions in the depth direction of the window frame, the respective outdoor side members thereof have the same dimensions in the depth direction of the window frame, and the respective heat insulating members thereof have the same dimensions in the depth direction of the window frame, thereby forming a heat insulating line continuous in the peripheral direction of the window frame; the respective indoor side members of the indoor side upper, lower, end and mating frame elements have the same dimensions in the depth direction of the indoor side sash, the respective outdoor side members thereof have the same dimensions in the depth direction of the indoor side sash, and the respective heat insulating members thereof have the same dimensions in the depth direction of the indoor side sash, thereby forming a heat insulating line continuous in the peripheral direction of the indoor side sash; and the respective indoor side members of the outdoor side upper, lower, end and mating frame elements have the same dimensions in the depth direction of the outdoor side sash, the respective outdoor side members thereof have the same dimensions in the depth direction of the outdoor side sash, and the respective heat insulating members thereof have the same dimensions in the depth direction of the outdoor side sash, thereby forming a heat insulating line continuous in the peripheral direction of the outdoor side sash.

According to this aspect of the present invention, the heat insulating lines of the window frame, the indoor side sash and the outdoor side sash are respectively formed continuously in their respective peripheral directions. Further, the indoor side sash is disposed at the indoor side relative to the heat insulating line of the window frame, and the indoor side members and the outdoor side members of the outdoor side sash are respectively disposed at the indoor side and the outdoor side relative to the heat insulating line of the window frame, thus improving the heat insulating performance of the sliding window. Furthermore, an air layer is formed at the mating portion of the indoor side and outdoor side mating frame elements, which improves the heat insulating performance at that portion.

As a further aspect of the present invention, there is provided a sliding window comprising both the air-tight structure and the heat insulating structure.

The nature and further features of the present invention will be made further clear from the following description made with reference to the accompanying drawings.

DESCRIPTION OF THE PREFERRED EMBODIMENT

It is first to be noted that terms of "upper", "lower", "right" and "left" and the like terms indicating directions are used herein with reference to the illustration of the drawings or in a state that a window frame is applied to a window.

Figure 1:
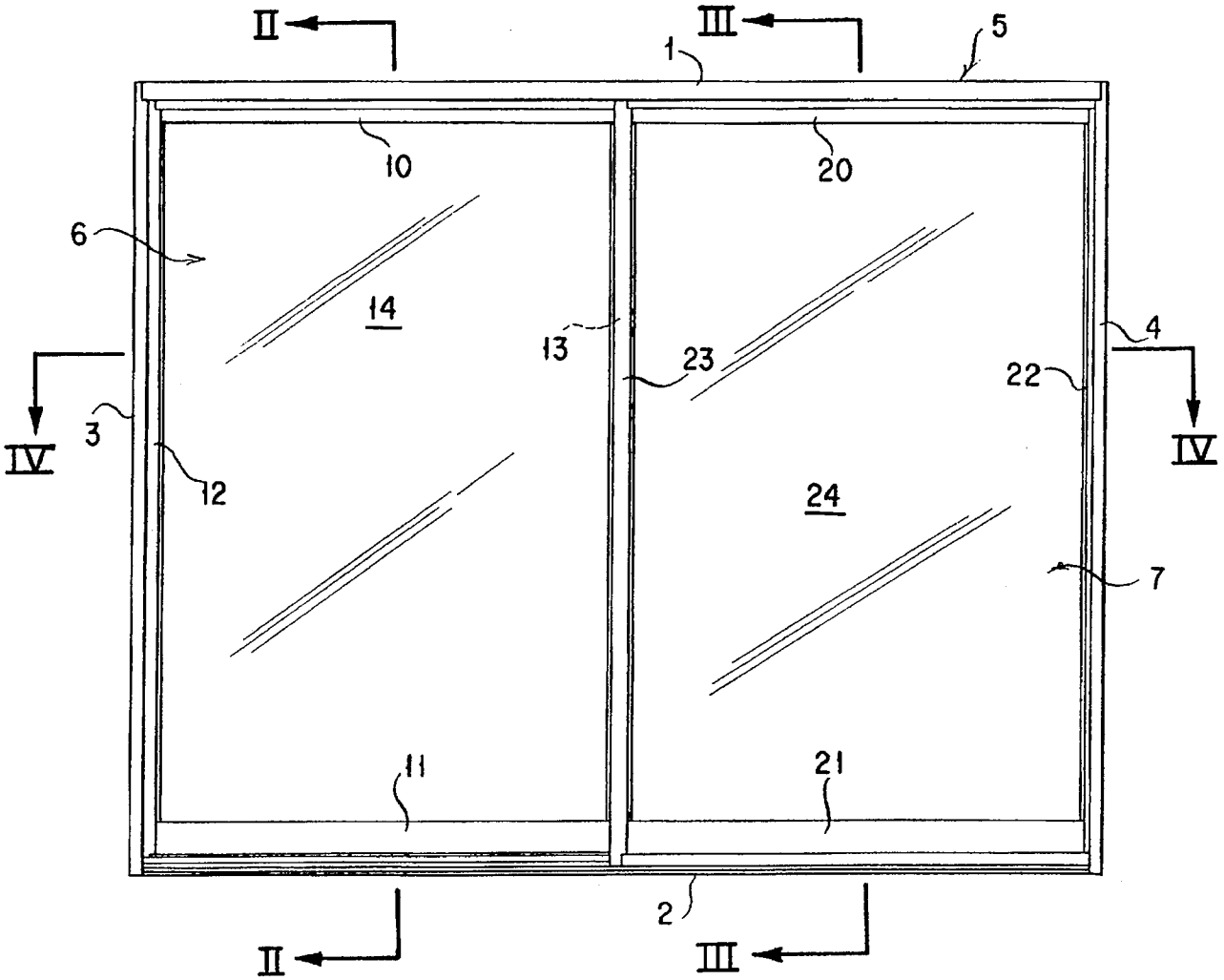
FIG. 1 is a general front view of an embodiment of a sliding window according to the present invention.

FIG. 1 is an illustration of a sliding window to which the present invention is applied, in which a window frame 5 is formed in rectangular shape of an upper frame member 1, a lower frame member 2 and bilateral side vertical frame members 3 and 4. An indoor side sash 6 is mounted at the indoor side of the window frame 5 so as to be slidable in the width direction of the window frame, and an outdoor side sash 7 is mounted at the outdoor side of the window frame 5 and fixed to the right side vertical frame member 4.

The indoor side sash 6 is formed of an indoor side upper frame element 10, an indoor side lower frame element 11, an indoor side end frame element 12, an indoor side mating frame element 13 and a glass 14 fitted in these frame elements which are assembled in a rectangular frame. The outdoor side sash 7 is formed of an outdoor side upper frame element 20, an outdoor side lower frame element 21, an outdoor side end frame element 22, an outdoor side mating frame element 23 and a glass 24 fitted in these frame elements which are assembled in a rectangular frame.

Figure 2:
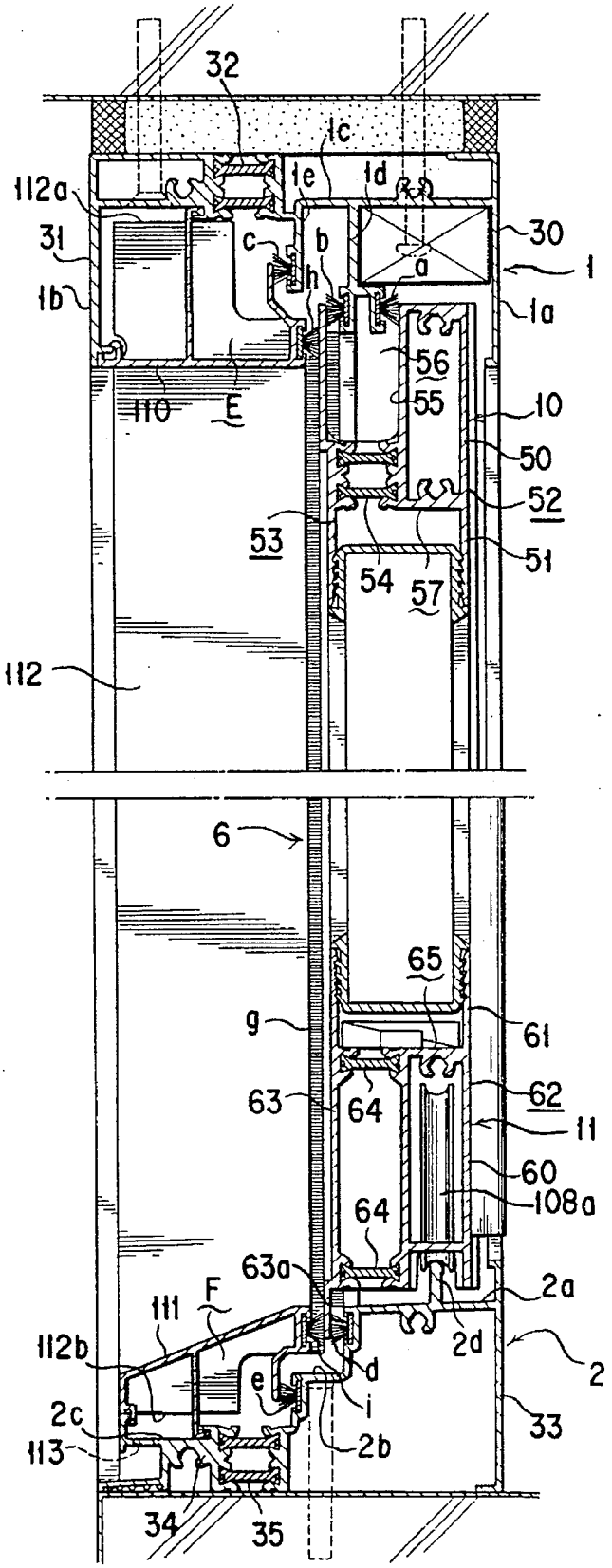
FIG. 2 shows an elevational section taken at the portion of an indoor side sash of the window of FIG. 1.
Figure 3:
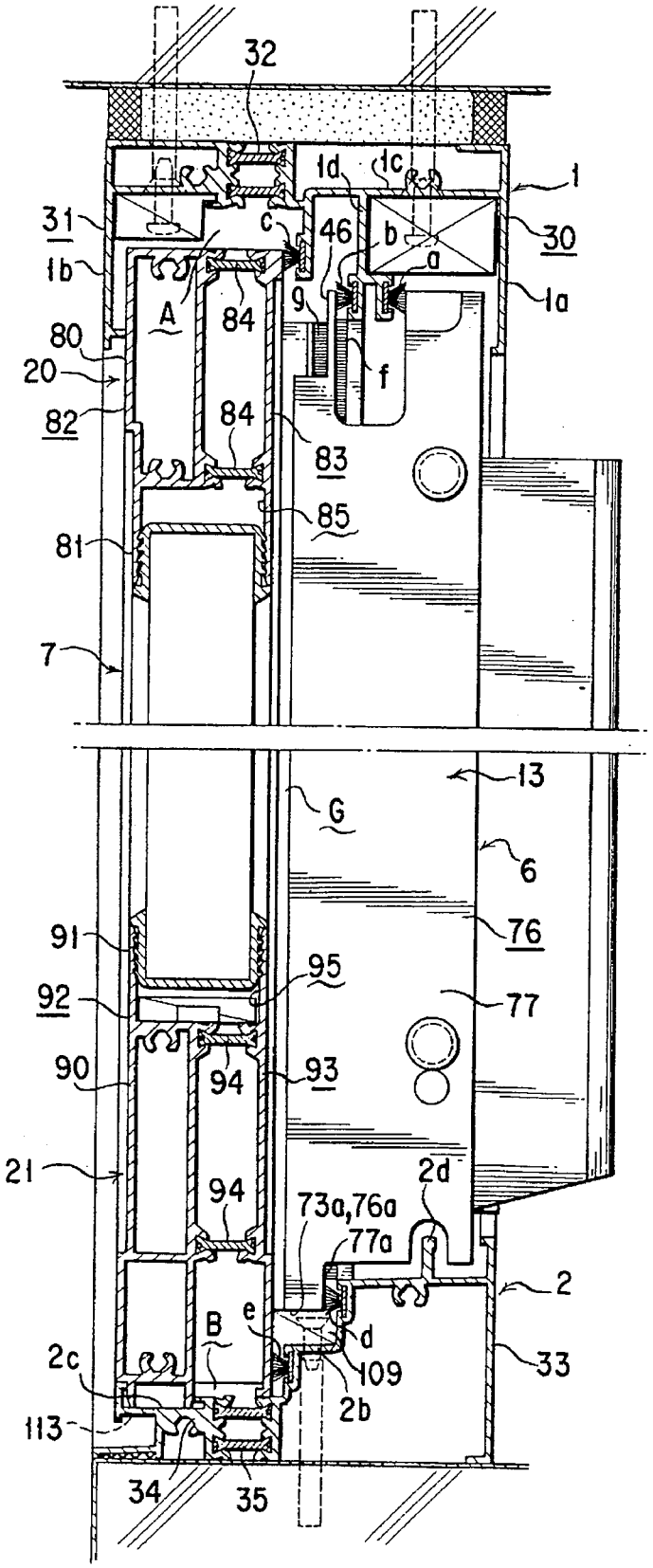
FIG. 3 shows an elevational section taken at the portion of an outdoor side sash of the window of FIG. 1.

As shown in FIGS. 2 and 3, the upper frame member 1 comprises an indoor side vertical plate 1*a* and an outdoor side vertical plate 1*b* which are integrally connected through a transverse plate 1*c*. An upper rail 1*d* is integrally formed to an indoor side portion of the transverse plate 1*c*, and an intermediate vertical piece 1*e* is integrally formed to an intermediate portion of the transverse plate 1*c*. First and second upper transverse air-tight members a and b are mounted to the upper rail 1*d*, and a third upper transverse air-tight member c is mounted to the intermediate vertical piece 1*e*.

The lower frame member 2 has a stepped upper surface having indoor side, intermediate and outdoor side upper surface portions 2*a*, 2*b* and 2*c*. A lower rail 2*d* is integrally formed to the indoor side upper surface portion 2*a*. The intermediate upper surface portion 2*b* has an L-shaped structure, to which first and second lower transverse air-tight members d and e are mounted towards the outdoor side. The outdoor side upper surface portion 2*c* is provided with a drain port 113, which may be provided to another frame element.

Figure 4:
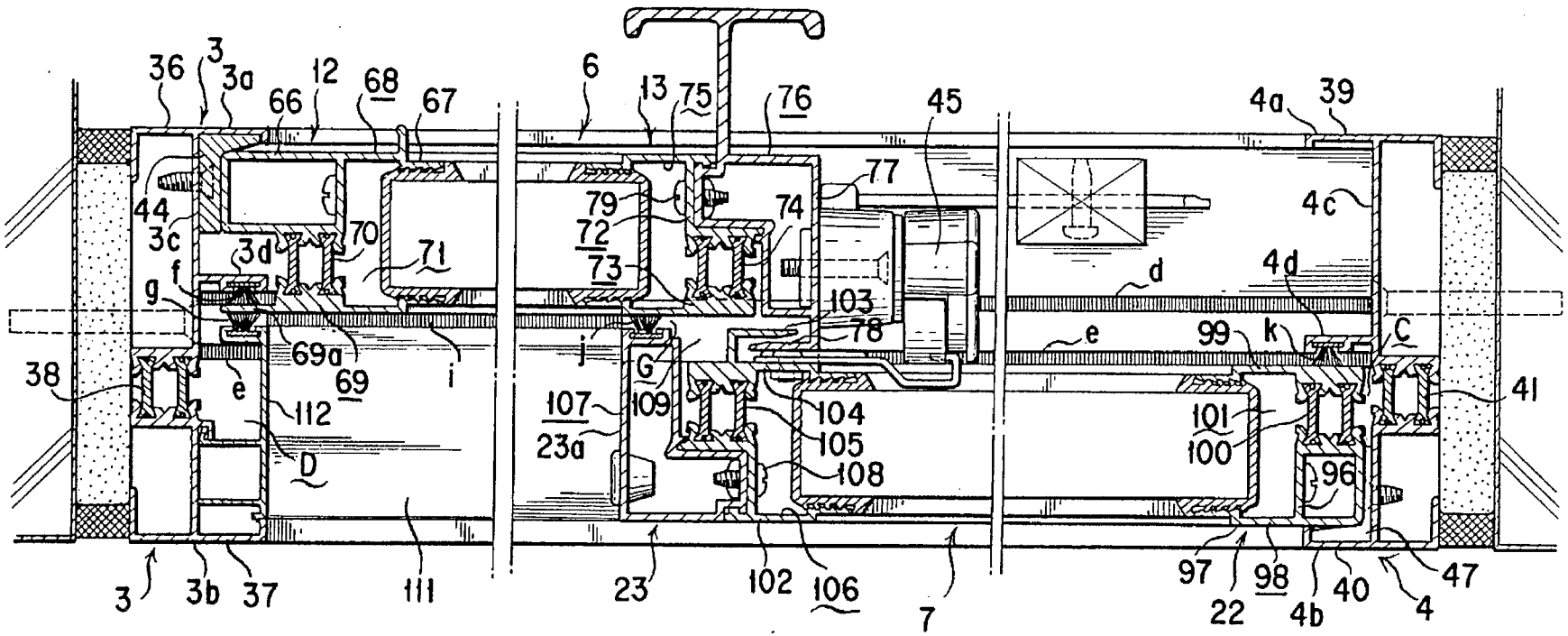
FIG. 4 shows a horizontal section of the window of FIG. 1.

As shown in FIG. 4, the left side vertical frame member 3 comprises an indoor side plate 3*a* and an outdoor side plate 3*b* which are integrally connected through a transverse plate 3*c*. An intermediate inward piece 3*d* is integrally formed to the transverse plate 3*c*, and a left side vertical air-tight member f is mounted to the intermediate inward piece 3*d* so as to be directed to the outdoor side. Similarly, the right side vertical frame member 4 comprises an indoor side plate 4*a* and an outdoor side plate 4*b* which are integrally connected through a transverse plate 4*c*. An intermediate inward piece 4*d* is integrally formed to the transverse plate 4*c*, and a right side vertical air-tight member k is mounted to the intermediate inward piece 4*d* so as to be directed to the outdoor side.

In this embodiment, the upper, lower and bilateral side vertical frame members 1, 2, 3 and 4 are each formed of a heat insulating frame unit, of which explanation will be made later. However, they may be each formed of an ordinary integral frame member made by extruding process.

Figure 5:
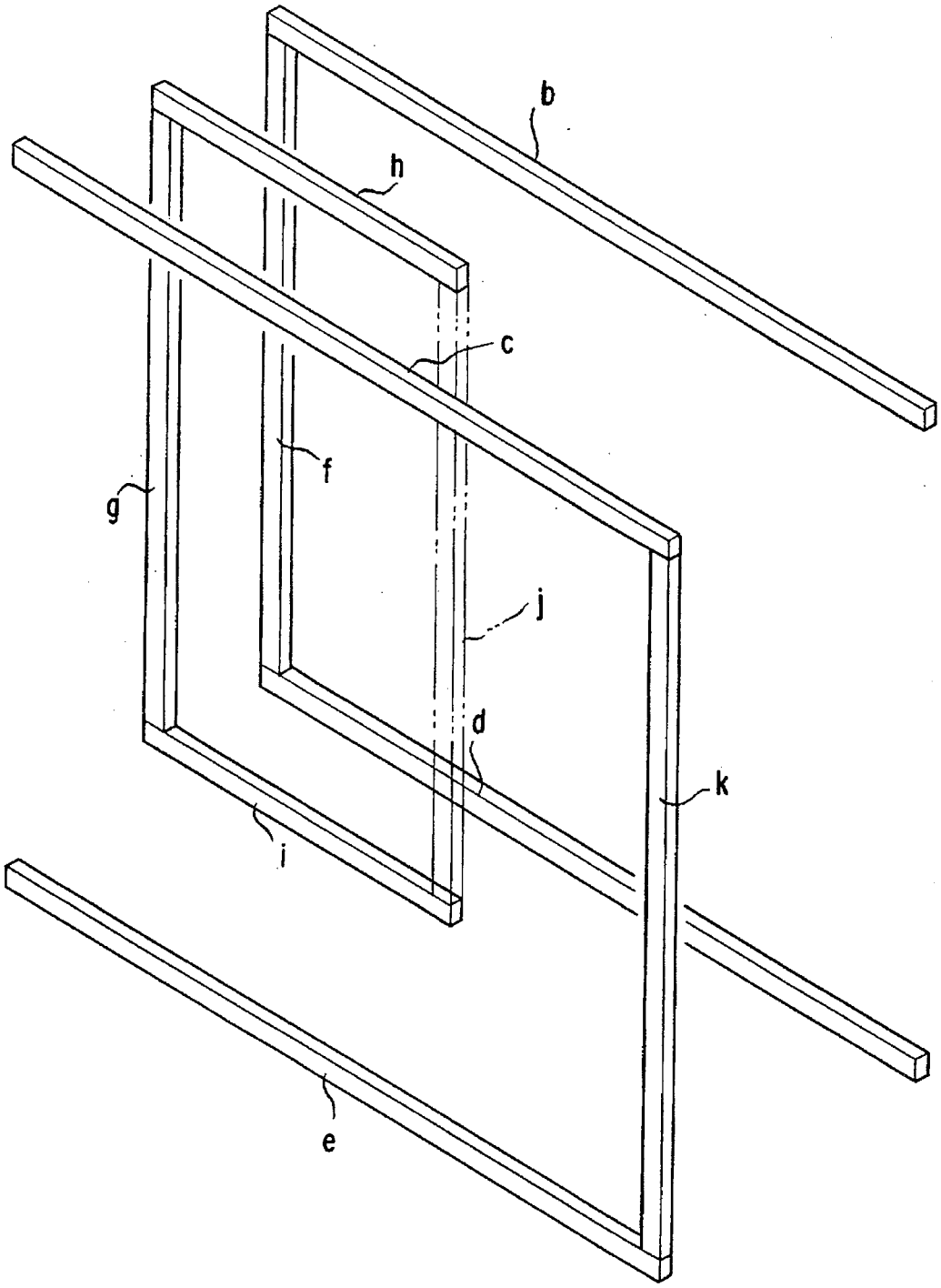
FIG. 5 is a perspective view showing an arrangement of air-tight members.

As shown in FIG. 5, the second upper transverse air-tight member b and the first lower transverse air-tight member d have the same location in the depth direction of the window frame, and are connected to the left side vertical air-tight member f at its upper and lower end portions. Similarly, the third upper transverse air-tight member c and the second lower transverse air-tight member e have the same location in the depth direction of the window, frame, and are connected to the right side vertical air-tight members k at its upper and lower end portions.

As shown in FIG. 2, the indoor side sash 6 has a sash sheave or roller 108*a* which is attached to the indoor side lower frame element 11 thereof so as to abut against the lower rail 2*d*. Further, the indoor side upper frame element 10 of the indoor side sash 6 is provided with an upward recessed portion 56, to which the upper rail 1*d* is fitted. Thus, the indoor side sash 6 is mounted to the window frame 5 so as to be slidable in the width direction of the window frame. As shown in FIG. 4, when the indoor side sash 6 is closed, the indoor side end frame element 12 comes into press abutment against an indoor side draw-up piece 44 which is formed of, for example, EPDM rubber material, and the indoor side sash 6 is pushed to the outdoor side by a sash fastener 45. Thus, the first and second upper transverse air-tight members a and b come into abutment against the upward recessed portion 56 as shown in FIG. 2, an upward projecting piece 46 which is formed by cutting out upper portions of the indoor side mating frame element 13 comes into abutment against the second upper transverse air-tight member b as shown in FIG. 3, a suspension piece 63*a* of the indoor side lower frame element 11 and a downward projecting piece 77*a* which is formed by cutting out a lower portion of the indoor side mating frame element 13 in a staged shape come into abutment against the first lower transverse air-tight member d as shown in FIGS. 2 and 3, and a projecting piece 69*a* of the indoor side end frame element 12 comes into abutment against the left side vertical air-tight member f as shown in FIG. 4, whereby the air-tight condition between the indoor side sash 6 and the window frame 5 is realized.

As shown in FIG. 3, the outdoor side upper frame element 20 of the outdoor side sash 7 is, at its outdoor side surface, in contact with the outdoor side vertical plate 1*b* of the upper frame member 1, and at its indoor side surface, in contact with the third upper transverse air-tight member c, thereby defining a first upper transverse space A between the outdoor side upper frame element 20 and the upper frame member 1. The outdoor side lower frame element 21 of the outdoor side sash 7 is in contact with the outdoor side upper surface portion 2*c* of the lower frame member 2, and at its indoor side surface, in contact with the second lower transverse air-tight member e, thereby defining a first lower transverse space B between the outdoor side lower frame element 21 and the lower frame member 2. The first lower transverse space B is opened to the outdoor atmosphere through the drain port 113. A lower wind block plate 109 is mounted to the mating portion of the lower frame member 2.

The outdoor side end frame element 22 is, at its outdoor side surface, in contact with a draw-up piece 47 which is formed of, for example, EPD rubber and mounted to the right side vertical frame member 4, and at its indoor side surface, in contact with the right side vertical air-tight member k, thereby defining a first vertical space C between the outdoor side end frame element 22 and the right side vertical frame member 4.

As shown in FIG. 4, an auxiliary vertical frame member 112 is attached to the outdoor side portion of the left side vertical frame member 3. When the indoor side sash 6 is closed, an auxiliary vertical air-tight member g mounted to the indoor side end portion of the auxiliary vertical frame member 112 comes into contact with the projecting piece 69*a* of the indoor side end frame element 12, thereby defining a second vertical space D between the outdoor side portion of the left side vertical frame member 3 and the auxiliary vertical frame member 112. The second vertical space D extends continuously to the outdoor side air-tight portion between the left side vertical frame member 3 and the indoor side end frame element 12.

As shown in FIG. 2, an auxiliary upper frame member 110 is attached to the upper frame member 1 at an outdoor side portion on the side of the left vertical frame member 3. The indoor side portion of the auxiliary upper frame member 110 is in contact with the third transverse air-tight member c. When the indoor side sash 6 is closed, an auxiliary upper transverse air-tight member h mounted to the indoor side portion of the auxiliary upper frame member 110 comes into contact with an upper portion of the outdoor side surface of the indoor side upper frame element 10, thereby defining the second upper transverse space E between the outdoor side portion of the upper frame member 1 and the auxiliary upper frame member 110.

Furthermore, as shown in FIGS. 2 and 4, an auxiliary lower frame member 111 is attached to the lower frame member 2 at an outdoor side portion on the side of the left vertical frame member 3. The indoor side portion of the auxiliary lower frame member 111 is in contact with the second lower transverse air-tight member e. When the indoor side sash 6 is closed, an auxiliary lower transverse air-tight member i mounted to the indoor side portion of the auxiliary lower frame member 111 comes into contact with the suspension piece 63*a* of the indoor side lower frame element 11 thereby defining the second lower transverse space F between the outdoor side portion of the lower frame member 2 and the auxiliary lower frame member 111.

As shown in FIG. 2, one longitudinal end portion of the auxiliary upper frame member 110 and one longitudinal end portion of the auxiliary lower frame member 111 are in contact with upper and lower portions of the auxiliary vertical frame member 112, respectively. Since a gap is formed between the upper end surface 112*a* of the auxiliary vertical frame member 112 and the upper frame member 1, the second upper transverse space E communicates with the second vertical space D, and since a gap is formed between the lower end surface 112*b* of the auxiliary vertical frame member 112 and the lower frame member 2, the second lower transverse space F communicates with the second vertical space D.

The other longitudinal end portion of the auxiliary upper frame member 110 and the other longitudinal end portion of the auxiliary lower frame member 111 are in contact with the outside surface 23*a* of the outdoor side mating frame element 23. Since a gap is formed between the upper end surface of the outdoor side mating frame element 23 and the upper frame member 1, the second upper transverse space E communicates with the first upper transverse space A, and since a gap is formed between the lower end surface of the outdoor side mating frame element 23 and the lower frame member 2, the second lower transverse space F communicates with the first lower transverse space B.

As shown in FIG. 5, the auxiliary upper transverse air-tight member h and the auxiliary lower transverse air-tight member i have the same location in the depth direction of the window frame and are connected to an auxiliary vertical air-tight member g at its upper and lower portions. As shown in FIG. 4, the indoor side mating frame element 13 and the outdoor side mating frame element 23 are kept in their air-tight condition through a mating air-tight member j.

As described above, according to the air-tight structure of the sliding window of the present invention, the upper and lower transverse spaces are formed between the left side and right side vertical frame members 3 and 4 on the outdoor side of the window frame 5, and the first vertical space C and the second vertical space D are formed on the outdoor side of the window frame 5 so as to communicate with the above mentioned upper and lower transverse spaces continuously, thereby forming a space continuous around the periphery of the window frame 5. Since the lower transverse space is opened to the outdoors through, for example, the drain port, the space continuous around the periphery of the window frame 5 is kept with a pressure equal to the outdoor atmospheric pressure, thereby improving the air-tight condition between the window frame 5 and the indoor side sash 6 and between the window frame 5 and the outdoor side sash 7.

Next, another aspect of the present invention which provides an improved heat insulating performance will be explained with reference to the same embodiment.

As previously described, the window frame 5 is formed in rectangular shape of the upper frame member 1, the lower frame member 2, the left side vertical frame member 3 and the right side vertical frame member 4.

As shown in FIGS. 2 and 3, the upper frame member 1 is formed of a heat insulating frame unit which is formed by connecting an indoor side member 30 and an outdoor side member 31, which are formed by extruding process, through a heat insulating member 32, and the lower frame member 2 is formed of a heat insulating frame unit which is formed by connecting an indoor side member 33 and an outdoor side member 34, which are formed by extruding process, through a heat insulating member 35. As shown in FIG. 4, the left side vertical frame member 3 is formed of a heat insulating frame unit which is formed by connecting an indoor side member 36 and an outdoor side member 37, which are formed by extruding process, through a heat insulating member 38, and the right side vertical frame member 4 is formed of a heat insulating frame unit which is formed by connecting an indoor side member 39 and an outdoor side member 40, which are formed by extruding process, through a heat insulating member 41.

The respective indoor side members of the upper, lower, left side vertical and right side vertical frame members 1, 2, 3 and 4 have the same dimensions in the depth direction of the window frame, the respective outdoor side members thereof have the same dimensions in the depth direction of the window frame, and the respective heat insulating members thereof have the same dimensions in the depth direction of the window frame. Thus, the heat insulating members 32, 35, 38 and 41 of the upper, lower, left side vertical and right side vertical frame members 1, 2, 3 and 4 have the same location in the depth direction of the window frame, thereby forming a heat insulating line continuous in the peripheral direction of the window frame 5.

As previously descibed, the indoor side sash 6 is formed of the indoor side upper frame element 10, the indoor side lower frame element 11, the indoor side end frame element 12, the indoor side mating frame element 13 and the glass 14 fitted in these frame elements which are assembled in the rectangular frame.

The indoor side upper frame element 10 is, as shown in FIG. 2, formed of a heat insulating frame unit which is formed by connecting an indoor side member 52 and an outdoor side member 53, which are formed by extruding process, through a heat insulating member 54. The indoor side member 52 is formed by integrally forming an indoor side support plate 51 to a hollow body 50 having a rectangular section, and the outdoor side member 53 is of a vertical plate shape. An upward recessed portion 56 is formed between an outdoor side surface 55 of the body 50 and an upper portion of the outdoor side member 53, and a downward recessed portion 57 is formed between the indoor side support plate 51 and a lower portion of the outdoor side member 53.

The indoor side lower frame element 11 is, as shown in FIG. 2, formed a heat insulating frame unit which is formed by connecting an indoor side member 62 and an outdoor side member 63, which are formed by extruding process, through a heat insulating member 64. The indoor side member 62 is formed by integrally forming an indoor side support plate 61 to a hollow body 60 having a rectangular section, and the outdoor side member 63 is of a vertical plate shape. An upward recessed portion 65 is formed between the indoor side support plate 61 and an upper portion of the outdoor side member 63.

The indoor side end frame element 12 is, as shown in FIG. 4, formed of a heat insulating frame unit which is formed by connecting an indoor side member 68 and an outdoor side member 69, which are formed by extruding process, through a heat insulating member 70. The indoor side member 68 is formed by integrally forming an indoor side support plate 67 to a hollow body 66 having a rectangular section, and the outdoor side member 69 is of a vertical plate shape. An inward recessed portion 71 is formed between the indoor side support plate 67 and the inside of the outdoor side member 69.

The indoor side side mating, i.e., overlapping frame element 13 is, as shown in FIG. 4, composed of a heat insulating frame unit and an outside vertical member 76 fastened thereto by means of vis. The heat insulating frame unit is formed by connecting an indoor side member 72 substantially in a crank shape in horizontal section and an outdoor side member 73 substantially in a plate shape in horizontal section, which are formed by extruding process, through a heat insulating member 74. An inward recessed portion 75 is formed between the indoor side member 72 and the outdoor side member 73. The outside vertical member 76 is composed of a hollow body 77 having the same dimension as that of the heat insulating frame unit in the depth direction of the indoor side sash 6, and an bent portion 78 integrally formed to the outdoor side end of the hollow body 77. The hollow body 77 is fastened to the indoor side member 72 by means of vis 79 so as to be separated from the outdoor side member 73.

The respective indoor side members of the indoor side upper, lower, end and mating frame elements 10, 11, 12 and 13 have the same dimensions in the depth direction of the indoor side sash 6, the respective outdoor side members thereof have the same dimensions in the depth direction of the indoor side sash 6, and the respective heat insulating members thereof have the same dimensions in the depth direction of the indoor sash 6. Thus, the heat insulating members 54, 64, 70 and 74 of the indoor side upper, lower, end and mating frame elements 10, 11, 12 and 13 have the same location in the depth direction of the indoor side sash 6, thereby forming a heat insulating line continuous in the peripheral direction of the indoor side sash 6.

As previously described, the outdoor side sash 7 is formed of the outdoor side upper frame element 20, the outdoor side lower frame element 21, the outdoor side end frame element 22, the outdoor side mating frame element 23 and the glass 24 fitted in these frame elements which are assembled in a rectangular frame.

The outdoor side upper frame element 20 is, as shown in FIG. 3, formed of a heat insulating frame unit which is formed by connecting an outdoor side member 82 and an indoor side member 83, which are formed by extruding process, through a heat insulating member 84. The outdoor side member 82 is formed by integrally forming an outdoor side support plate 81 to a hollow body 80 having a rectangular section, and the indoor side member 83 is of a vertical plate shape. A downward recessed portion 85 is formed between the outdoor side support plate 81 and a lower portion of the indoor side member 83.

The outdoor side lower frame element 21 is, as shown in FIG. 3, formed of a heat insulating frame unit which is formed by connecting an outdoor side member 92 and an indoor side member 93, which are formed by extruding process, through a heat insulating member 94. The outdoor side member 92 is formed by integrally forming an outdoor side support plate 91 to a hollow body 90 having a rectangular section, and the indoor side member 93 is of a vertical plate shape. An upward recessed portion 95 is formed between the outdoor side support plate 91 and an upper portion of the indoor side member 93.

The outdoor side end frame element 22 is, as shown in FIG. 4, formed of a heat insulating frame unit which is formed by connecting an outdoor side member 98 and an indoor side member 99, which are formed by extruding process, through a heat insulating member 100. The outdoor side member 98 is formed by integrally forming an outdoor side support plate 97 to a hollow body 96 having a rectangular section, and the indoor side member 99 is of a vertical plate shape. An inward recessed portion 101 is formed between the outdoor side support plate 97 and the inside of the indoor side member 99.

The outdoor side mating frame element 23 is, as shown in FIG. 4, composed of a heat insulating frame unit and an outside vertical member 107 fastened thereto by means of vis. The heat insulating frame unit is formed by connecting an outdoor side member 102 substantially in a crank shape in horizontal section and an indoor side member 104 substantially in a plate shape in horizontal section and provided with a bent portion 103, which are formed by extruding process, through a heat insulating member 105. An inward recessed portion 106 is formed between the outdoor side member 102 and the indoor side member 104. The outside vertical member 107 is formed of a hollow body having a hook-shaped horizontal section and having a dimension slightly larger than that of the heat insulating frame unit in the depth direction of the outdoor side sash 7, and is fastened to the outdoor side member 102 by means of vis 108 so as to be separated from the indoor side member 104.

The respective indoor side members of the outdoor side upper, lower, end and mating frame elements 20, 21, 22 and 23 have the same dimensions in the depth direction of the outdoor side sash 7, the respective outdoor side members thereof have the same dimensions in the depth direction of the outdoor side sash 7, and the respective heat insulating members thereof have the same dimensions in the depth direction of the outdoor side sash 7. Thus, the heat insulating members 84, 94, 100 and 105 of the outdoor side upper, lower, end and mating frame elements 20, 21, 22 and 23 have the same location in the depth direction of the outdoor side sash 7, thereby forming a heat insulating line continuous in the peripheral direction of the outdoor side sash 7.

As shown in FIG. 2, a sash sheave or roller 108*a* is attached to the indoor side member 62 of the indoor side lower frame element 11 of the indoor side sash 6 so as to abut against a lower rail 2*d* of the indoor side member 33 of the lower frame member 2. An upper rail 1*d* of the indoor side member 30 of the upper frame member 1 projects into the upward recessed portion 56 of the indoor side upper frame element 10, and first and second upper transverse air-tight members a and b mounted to the upper rail 1*d* are in contact with both side vertical surfaces of the upward recessed portion 56. Thus, the indoor side sash 6 is freely movable in the width direction of the window frame.

The indoor side member 33 of the lower frame member 2 has a stepped upper surface including the intermediate upper surface portion 2*b*. A first lower transverse air-tight member d is mounted to the indoor side member 33 at the indoor side relative to the intermediate upper surface portion 2*b* and above the intermediate upper surface portion 2*b*. A second lower transverse air-tight member e is mounted to the indoor side member 33 at the outdoor side relative to the intermediate upper surface portion 2*b* and below the intermediate upper surface portion 2*b*.

The first lower transverse air-tight member d is in contact with a suspension piece 63*a* of the outdoor side member 63 of the indoor side lower frame element 11 and with a vertical surface 77*a* which is formed by cutting out a lower portion of the body 77 of the outside vertical member 76. At the mating portion, a lower window block plate 109 is fastened to the intermediate upper surface portion 2*b* by means of vis, so that when the indoor side sash 6 is closed, a lower end surface 73*a* of the outdoor side member 73 of the indoor side mating frame element 13 and a lower end surface 76*a* of the outdoor side portion of the outside vertical member 76 come into contact with the lower wind block plate 109.

With the outdoor side sash 7, as shown in FIGS. 3 and 4, the outdoor side member 82 of the outdoor side upper frame element 20 is supported by the outdoor side member 31 of the upper frame member 1, and the indoor side member 83 of the outdoor side upper frame element 20 is in contact with a third upper transverse air-tight member c mounted to the indoor side member 30 of the upper frame member 1. The outdoor side member 92 of the outdoor side lower frame element 21 is supported by the outdoor side member 34 of the lower frame member 2, and the indoor side member 93 of the outdoor side lower frame element 21 is in contact with a second lower transverse air-tight member e and the lower wind block plate 109 which are mounted to the indoor side member 33 of the lower frame member 2. The outdoor side member 98 of the outdoor side end frame element 22 is fastened to the outdoor side member 40 of the right side vertical frame member 4 by means of vis, and the indoor side member 99 of the outdoor side end frame element 22 is in contact with a right side vertical air-tight member k mounted to the indoor side member 39 of the right side vertical frame member 4. Further, when the indoor side sash 6 is closed, a mating air-tight member j mounted to the indoor side end portion of the outside vertical member 107 of the outdoor side mating frame element 23 comes into contact with the outdoor side member 73 of the indoor side mating frame element 13.

According to the structure described above, when the indoor side sash 6 is closed, an air layer G is formed at the mating portion between the indoor side mating frame element 13 and the outdoor side mating frame element 23, which improves a heat insulating performance at this portion. Though the air layer G communicates with the indoor side portion with a small area, it can be disregarded from the view point of heat insulation because of its small area and complicated structure.

As shown in FIG. 2, an auxiliary upper frame member 110 is fastened to the outdoor side member 31 of the upper frame member 1 by means of vis. The auxiliary upper frame member 110 is in contact with a third upper transverse air-tight member c mounted to the indoor side member 30 of the upper frame member 1, and when the indoor side sash 6 is closed, an auxiliary upper transverse air-tight member h mounted to the indoor side portion of the auxiliary upper frame member 110 comes into contact with the outdoor side member 53 of the indoor side upper frame element 10, thereby defining the second upper transverse space E.

Further in FIG. 2, an auxiliary lower frame member 111 is fastened to the outdoor side member 34 of the lower frame member 2 by means of vis. The auxiliary lower frame member 111 is in contact with the second lower transverse air-tight member e mounted to the indooe side member 33 of the lower frame member 2, and when the indoor side sash 6 is closed, an auxiliary lower transverse air-tight member i mounted to the indoor side portion of the auxiliary lower frame member 111 comes into contact with the suspension piece 63*a* of the outdoor side member 63 of the indoor side lower frame element 11 of the indoor side sash 6, thereby defining the second lower transverse space F.

As shown in FIG. 4, an auxiliary vertical frame member 112 is attached to the outdoor side member 37 of the left side vertical frame member 3. When the indoor side sash 6 is closed, the projection piece 69*a* of the outdoor side member 69 of the indoor side end frame element 12 comes in contact with an auxiliary vertical air-tight member g mounted to the auxiliary vertical frame member 112 and with a left side vertical air-tight member f mounted to the indoor side member 36 of the left side frame member 3, thereby defining a second vertical space D. The second vertical space D communicates with the second upper transverse space E and the second lower transverse space F. The second upper transverse space E communicates with a first upper transverse space A formed between the upper frame member 1 and the outdoor side upper frame element 20, and the second lower transverse space F communicates with a first lower transverse space B formed between the lower frame member 2 and the outdoor side lower frame element 21. The first upper transverse space A and the first lower transverse space B respectively communicate a first vertical space C formed between the right side vertical frame member 4 and the outdoor side end frame element 22. Thus, a space continuous in the peripheral direction of the window frame 5 is formed at the outdoor side portion of the window frame 5. Since this continuous space communicates with the outdoors through a drain port 113 formed to the outdoor side member 34 of the lower frame member 2, the space has a pressure equal to the outdoor atmospheric pressure, whereby an air-tight condition between the window frame 5 and the indoor side and outdoor side sashes 6 and 7 is improved. Such air-tight structure was previously described separately in detail.

The indoor side mating frame element 13 is composed of a heat insulating frame unit which is formed by connecting the indoor side member 72 and the outdoor side member 73 through a heat insulating member 74, and the outside vertical member 76 fastened to the indoor side member 72 by means of vis. The outside vertical member 76 projects to the outdoor side member 73, and the projecting portion of the outside vertical member 76 and the outdoor side member 73 are separated from each other so as to form a gap for accomodating an air layer between the heat insulating member 74 and the projecting portion of the outside vertical member 76. Thus, the transverse sectional area of the air layer G at the mating portion of the indoor side and outdoor side mating frame elements is made large.

When the heat insulating member 74 is formed of a rigid or semi-rigid resin material by extruding process and fitted to the recessed portions of the indoor side and outdoor side members 72 and 73 and then fixed through calking process so as to form a heat insulating frame unit, according to the present embodiment, the heat insulating member 74 can be fixed in the condition that the outdoor side member 76 is not placed, so that the calking works can be done from both sides in the depth direction of the window frame. Thus, the connecting works of the heat insulating frame unit can be performed easily. This advantage applies also to the outdoor side mating frame element 23.

According to the heat insulating structure of the present invention, the heat insulating lines formed to the window frame 5, the indoor side sash 6 and the outdoor side sash 7 are respectively continuous in their respective peripheral directions. Further, the indoor side sash 6 is positioned at the indoor side relative to the heat insulating line of the window frame 5, and the outdoor side and indoor side members of the outdoor side sash 7 are respectively positioned at the outdoor side and indoor side relative to the heat insulating line of the window frame 5, so that the heat insulating performance can be effectively improved. Still furthermore, the presence of the air layer G at the mating portion of the indoor side and outdoor side mating frame elements can improve the heat insulating performance at that portion.

The heat insulating structure of the present invention was described with reference to the embodiment in which only the indoor side sash is slidable in the width direction of the window frame while the outdoor side sash is fixed to the window frame. However, the heat insulating structure of the present invention can also be applied to such sliding window in which both the indoor side and outdoor side sashes are slidable in the width direction of the window frame without requiring any specific technology more than that described above.

Furthermore, as is clear from the embodiment described above, the air-tight structure and the heat insulating structure can be combined to provide a sliding window having both the improved air-tight performance and the improved heat insulating performance.

It is to be noted that the present invention is not limited to the described embodiment, and that many other changes and modifications may be made without departing from the scopes of the appended claims.

What is claimed is:

1. A sliding window comprising:

a window frame of a rectangular shape having an upper flame member, a lower frame member, and first and second vertical frame members and an indoor and an outdoor side;

an indoor side sash having an indoor side upper frame element, an indoor side lower frame element, an indoor side end frame element and an indoor side mating frame element; and an outdoor side sash having an outdoor side upper frame element, an outdoor side lower frame element, an outdoor side end frame element and an outdoor side mating frame element, wherein said indoor side sash is mounted at the indoor side of the window frame so as to be slidable in a direction between the vertical frame members of the window frame and first air tight members are provided so as to establish airtightness between the window frame and the indoor side sash when the indoor side sash is closed, wherein said outdoor side sash is mounted at the outdoor side of the window frame and fixed to the first vertical frame member in such manner that a first upper transverse space is defined between the upper frame member and the outdoor side upper frame element, a first lower transverse space is defined between the lower frame member and the outdoor side lower frame element and a first vertical space is defined between the first vertical frame member and the outdoor side end frame element, said first vertical space communicating with said first upper transverse space and said first lower transverse space, and second air-tight members are provided to establish air-tightness between the window frame and the outdoor side sash, wherein said upper frame member is provided at the outdoor side with an auxiliary upper frame member on the side of the second vertical frame member so as to define therebetween a second upper transverse space communicating with said first upper transverse space, said lower frame member is provided at the outdoor side with an auxiliary lower frame member on the side of the second vertical frame element so as to define therebetween a second lower transverse space communicating with said first lower transverse space, and said second vertical frame member is provided at the outdoor side with an auxiliary vertical frame member so as to define therebetween a second vertical space communicating with said second upper and second lower transverse spaces, and wherein at least one of said first upper transverse space, said first lower transverse space, said first vertical space, said second upper transverse space, said second lower transverse space and said second vertical space is provided with a port communicating with an atmosphere outside the window, whereby a space continuous in the peripheral direction of the window frame and having a pressure equal to the atmospheric pressure outside the window is formed by said first upper transverse space, said first lower transverse space, said first vertical space, said second upper transverse space, said second lower transverse space and said second vertical space at the outdoor side of the window frame on the outdoor side of the air-tight members.

2. A sliding window according to claim 1, wherein said port is a drain port formed to said first lower transverse space.

3. A sliding window according to claim 1, wherein the respective frame members constituting said window frame, the respective frame elements constituting said indoor side sash and the respective frame elements constituting said outdoor side sash are formed of heat insulating frame side member and an outdoor side member connected by a heat insulating member positioned therebetween.

4. A sliding window comprising:

a window frame of a rectangular shape comprising, in an installed state, an upper frame member, a lower frame member, and first and second vertical frame members, each of said frame members comprising a heat insulating frame unit comprising an indoor side member and an outdoor side member connected by a heat insulating member positioned therebetween;

an indoor side sash comprising an indoor side upper frame element, an indoor side lower frame element, an indoor side end frame element and an indoor side mating frame element, each of said frame elements comprising a heat insulating frame unit comprising an indoor side member and an outdoor side member connected by a heat insulating member positioned therebetween; and an outdoor side sash comprising an outdoor side upper frame element, an outdoor side lower frame element, an outdoor side end frame element and an outdoor side mating frame element, each of said frame elements comprising a heat insulating unit comprising an indoor side member and an outdoor side member connected by a heat insulating member positioned therebetween, wherein said window frame provides a heat insulating line formed by said heat insulating members comprised in said upper lower and first and second vertical frame members and extending continuously in the peripheral direction of the window frame, said indoor side sash provides a heat insulating line formed by said heat insulating members comprised in said indoor side upper lower, end and mating frame elements and extending continuously in the peripheral direction of the indoor side sash, said outdoor side sash provides a heat insulating line formed by said insulating members comprised in said outdoor side upper, lower end and mating frame elements and extending continuously in the peripheral direction of the outdoor side sash, wherein said indoor side sash is mounted to the indoor side relative to the heat insulating line of the window frame, and said outdoor side sash is mounted to the window frame in such manner that the outdoor side members of the respective frame elements of the outdoor side sash are positioned at the outdoor side relative to the heat insulating line of the window frame and the indoor side members of the respective frame elements of the outdoor side sash are positioned at the indoor side relative to the heat insulating line of the window frame, and wherein said indoor side mating member of said indoor side sash further comprises an outside vertical member and said outdoor side mating member of said outdoor side sash further comprises an outside vertical member, said outside vertical members being so arranged that when said indoor side and outdoor side sashes are closed, said outside vertical member of the indoor side mating frame element is opposed to said indoor side member of the outdoor side mating frame element and said outdoor side member of the indoor side mating frame element contacts said outside vertical member of the outdoor side mating frame element through an air-tight member, thereby forming an air layer at a mating portion formed by the indoor side and outdoor side mating frame elements.

5. A sliding window according to claim 4, wherein the respective indoor side members of said upper, lower, left side vertical and right side vertical frame members have the same dimensions in the depth direction of the window frame, the respective outdoor side members thereof have the same dimensions in the depth direction of the window frame, and the respective heat insulating members thereof have the same dimensions in the depth direction of the window frame, thereby forming a heat insulating line continuous in the peripheral direction of the window frame; the respective indoor side members of said indoor side upper, lower, end and mating frame elements have the same dimensions in the depth direction of the indoor side sash, the respective outdoor side members thereof have the same dimensions in the depth direction of the indoor side sash, and the respective heat insulating members thereof have the same dimensions in the depth direction of the indoor side sash, thereby forming a heat insulating line continuous in the peripheral direction of the indoor side sash; and the respective indoor side members of said outdoor side upper, lower, end and mating frame elements have the same dimensions in the depth direction of the outdoor side sash, the respective outdoor side members thereof have the same dimensions in the depth direction of the outdoor side sash, and the respective heat insulating members thereof have the same dimensions in the depth direction of the outdoor side sash, thereby forming a heat insulating line continuous in the peripheral direction of the outdoor side sash.

6. A sliding window comprising:

a window frame of a rectangular shape comprising, in an installed state, an upper frame member, a lower frame member, and first and second vertical frame members;

an indoor side sash comprising an indoor side upper frame element, an indoor side lower frame element, an indoor side end frame element and an indoor side mating frame element; and an outdoor side sash comprising an outdoor side upper frame element, an outdoor side lower frame element, an outdoor side end frame element and an outdoor side mating frame element, wherein said indoor side sash is mounted at an indoor side of the window frame so as to be slidable in the width direction of the window frame and air tight members are provided so as to establish air-tightness between the window frame and the indoor side sash when the indoor side sash is closed, wherein said outdoor side sash is mounted at an outdoor side of the window frame and fixed to the first vertical frame member in such manner that a first upper transverse space is defined between the upper frame member and the outdoor side upper frame element, a first lower transverse space is defined between the lower frame member and the outdoor side lower frame element and a first vertical space is defined between the first vertical frame member and the outdoor side end frame element, said first vertical space communicating with said first upper transverse space and said first lower transverse space, and air-tight members are provided to establish air-tightness between the window frame and the outdoor side sash, wherein said upper frame member is provided at its outdoor side with an auxiliary upper frame member on the side of the second vertical frame member so as to define therebetween a second upper transverse space communicating with said first upper transverse space, said lower frame member is provided at its outdoor side with an auxiliary lower frame member on the side of the second vertical frame element so as to define therebetween a second lower transverse space communicating with said first lower transverse space, and said second vertical frame member is provided at its outdoor side with an auxiliary vertical frame member so as to define therebetween a second vertical space communicating with said second upper and second lower transverse spaces, and wherein at least one of said first upper transverse space, said first lower transverse space, said first vertical space, said second upper transverse space, said second lower transverse space and said second vertical space is provided with a port communicating with an atmosphere outside the window, whereby a space continuous in the peripheral direction of the window frame and having a pressure equal to the atmospheric pressure outside the window is formed by said first upper transverse space, said first lower transverse space, said first vertical space, said second upper transverse space, said second lower transverse space and said second vertical space at the outdoor side of the window frame in front of the portions where said air-tight members are provided, wherein each of said upper, lower, and first and second vertical frame members of the window frame comprises a heat insulating frame unit comprising an indoor side member and an outdoor side member connected by a heat insulating member positioned therebetween each of said indoor side upper, lower end, and mating frame elements of the indoor side sash includes a heat insulating frame unit having an indoor side member and an outdoor side member connected by a heat insulating member positioned therebetween, and each of said outdoor side upper, lower end, and mating frame elements of the outdoor side sash include a heat insulating frame unit having an indoor side member and an outdoor side member connected by an heat insulating member positioned therebetween, wherein said window frame provides a heat insulating line formed by said heat insulating members in said upper lower and first and second vertical frame members and extending continuously in the peripheral direction of the window frame, said indoor side sash provides a heat insulating line formed by said heat insulating members comprised in said indoor side upper, lower, end and mating frame elements and extending continuously in the peripheral direction of the indoor side sash, and said outdoor side sash provides a heat insulation line formed by said heat insulating members comprised in said outdoor side upper, lower end, and mating frame elements and extending continuously in the peripheral direction of the outdoor aide sash, wherein said indoor side sash is mounted to the indoor side relative to the heat insulating line of the window frame, and said outdoor side sash is mounted to the window frame in such manner that the outdoor side members of the respective frame elements of the outdoor side sash are positioned at the outdoor side relative to the heat insulating line of the window frame and the indoor side members of the respective frame elements of the outdoor side sash are positioned at the indoor side relative to the heat insulating line of the window frame, and wherein said indoor side mating member of said indoor side sash further comprises an outside vertical member and said outdoor side mating member of said outdoor side sash further comprises an outside vertical member, said outside vertical members being so arranged that when said indoor side and outdoor side sashes are closed, said outside vertical member of the indoor side mating frame element is opposed to said indoor side member of the outdoor side mating frame element and said outdoor side member of the indoor side mating frame element contacts said outside vertical member of the outdoor side mating frame element through an air-tight member, thereby forming an air layer at a mating portion formed by the indoor side and outdoor side mating frame elements.

* * * * *

UNITED STATES PATENT AND TRADEMARK OFFICE

CERTIFICATE OF CORRECTION

PATENT NO. : 5,653,060

DATED : August 05, 1997

INVENTOR(S) : Ryuichi KITADA et al.

It is certified that error appears in the above-identified patent and that said Letters Patent is hereby corrected as shown below:

Claim 1, column 14, line 13, "flame" should read --frame--.

Claim 1, column 14, line 28, "air tight" should read --airtight--.

Claim 1, column 14, line 43, "air-tightness" should read --airtightness--.

Claim 1, column 15, line 6, "air-tight" should read --airtight--.

Claim 4, column 15, line 41, "upper lower" should read --upper, lower,--.

Claim 4, column 16, line 8, "air-tight" should read --airtight--.

Claim 6, column 16, line 53, "air tight" should read --airtight--.

UNITED STATES PATENT AND TRADEMARK OFFICE

CERTIFICATE OF CORRECTION

PATENT NO. : 5,653,060

DATED : August 05, 1997

INVENTOR(S) : Ryuichi KITADA et al.

It is certified that error appears in the above-indentified patent and that said Letters Patent is hereby corrected as shown below:

Claim 6, column 16, line 54, "air-tightness" should read --airtightness--.

Claim 6, column 16, line 67, "air-tight" should read --airtight--.

Claim 6, column 17, line 1, "air-tightness" should read --airtightness--.

Claim 6, column 17, line 31, "air-tight" should read --airtight--.

Claim 6, column 18, line 2, "an heat" should read --a heat--.

Claim 6, column 18, line 5, "upper lower" should read --upper, lower,--.

UNITED STATES PATENT AND TRADEMARK OFFICE

CERTIFICATE OF CORRECTION

PATENT NO. : 5,653,060

DATED : August 05, 1997

INVENTOR(S) : Ryuichi KITADA et al.

It is certified that error appears in the above-indentified patent and that said Letters Patent is hereby corrected as shown below:

Claim 6, column 18, line 17, "aide" should read --side--.

Claim 6, column 18, line 38, "air-tight" should read --airtight--.

Signed and Sealed this

First Day of December, 1998

*Attest:*

*Attesting Officer*

Bruce Lehman

BRUCE LEHMAN

*Commissioner of Patents and Trademarks*